US008899991B2

(12) United States Patent
Ickler

(10) Patent No.: US 8,899,991 B2
(45) Date of Patent: Dec. 2, 2014

(54) ROTATABLE ELECTRICAL COUPLING AND CONNECTOR THEREFOR

(75) Inventor: Fritz Ickler, Kirchheim (DE)

(73) Assignee: Ondal Medical Systems GmbH, Hunfeld (DE)

( * ) Notice: Subject to any disclaimer, the term of this patent is extended or adjusted under 35 U.S.C. 154(b) by 83 days.

(21) Appl. No.: 13/500,601

(22) PCT Filed: Sep. 30, 2010

(86) PCT No.: PCT/EP2010/005981

§ 371 (c)(1), (2), (4) Date: May 1, 2012

(87) PCT Pub. No.: WO2011/042133

PCT Pub. Date: Apr. 14, 2011

(65) Prior Publication Data

US 2012/0220141 A1 Aug. 30, 2012

(30) Foreign Application Priority Data

Oct. 9, 2009 (EP) ..... 09012828

(51) Int. Cl.

| | |
|---|---|
| ***H01R 39/00*** | (2006.01) |
| ***H01R 24/40*** | (2011.01) |
| ***H01R 39/08*** | (2006.01) |
| ***H01R 39/64*** | (2006.01) |
| *H01R 103/00* | (2006.01) |

(52) U.S. Cl.

CPC ..... *H01R 39/08* (2013.01); *H01R 24/40* (2013.01); *H01R 39/64* (2013.01); *H01R 2103/00* (2013.01)

USPC ..... 439/11

(58) Field of Classification Search

USPC ..... 439/11, 21–26, 13, 28, 668; 310/232

See application file for complete search history.

(56) References Cited

U.S. PATENT DOCUMENTS

| | | | | |
|---|---|---|---|---|
| 6,561,813 | B2 | 5/2003 | Rutten et al. | 439/26 |
| 7,001,184 | B2 * | 2/2006 | Abouchar | 439/26 |
| 7,074,044 | B2 | 7/2006 | Billing et al. | 439/23 |
| 7,137,822 | B1 * | 11/2006 | Longmire et al. | 439/24 |
| 7,481,655 | B2 * | 1/2009 | Horst et al. | 439/24 |
| 2009/0286427 | A1 | 11/2009 | Bolin et al. | |

FOREIGN PATENT DOCUMENTS

| | | |
|---|---|---|
| EP | 1227554 | 7/2002 |
| WO | 03/092127 | 11/2003 |

* cited by examiner

*Primary Examiner* — Jean F Duverne

(74) *Attorney, Agent, or Firm* — Seed IP Law Group PLLC

(57) ABSTRACT

A rotatable electrical coupling comprising a male connector having at least one electrical contact member for conducting or transmitting a supply current or a low-frequency control signal, and a further electrical contact member for conducting or transmitting a high-frequency and/or a high-speed data signal. The coupling further comprises a female connector for receiving the male connector such that the male connector is adapted for rotation relative to the female connector. The female connector includes complementary electrical contact members configured to maintain uninterrupted electrical contact with each of the respective contact members of the male connector throughout a relative rotational movement between the male and female connectors preferably at least about 180°. An electrical connector for such a rotatable electrical coupling, as well as a swivel or pivot joint of a mounting arm for supporting or suspending technical equipment, wherein the joint incorporates such an electrical coupling.

15 Claims, 2 Drawing Sheets

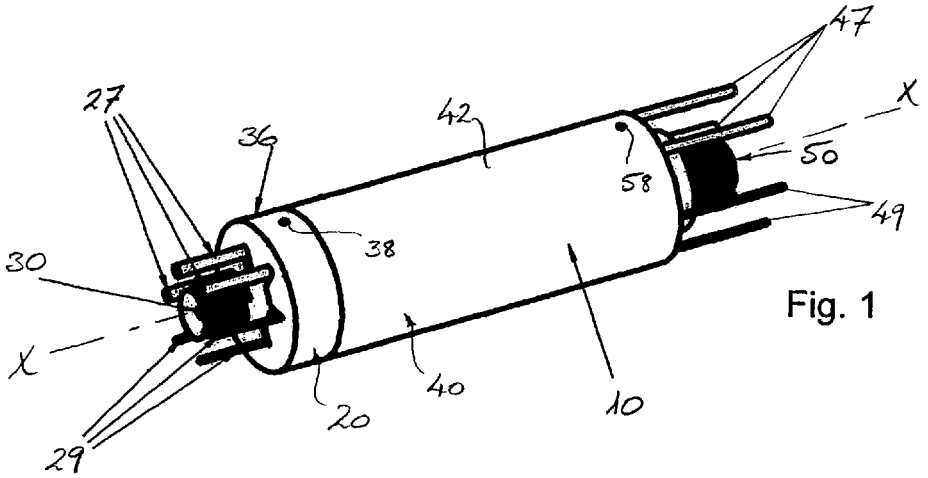
Fig. 1
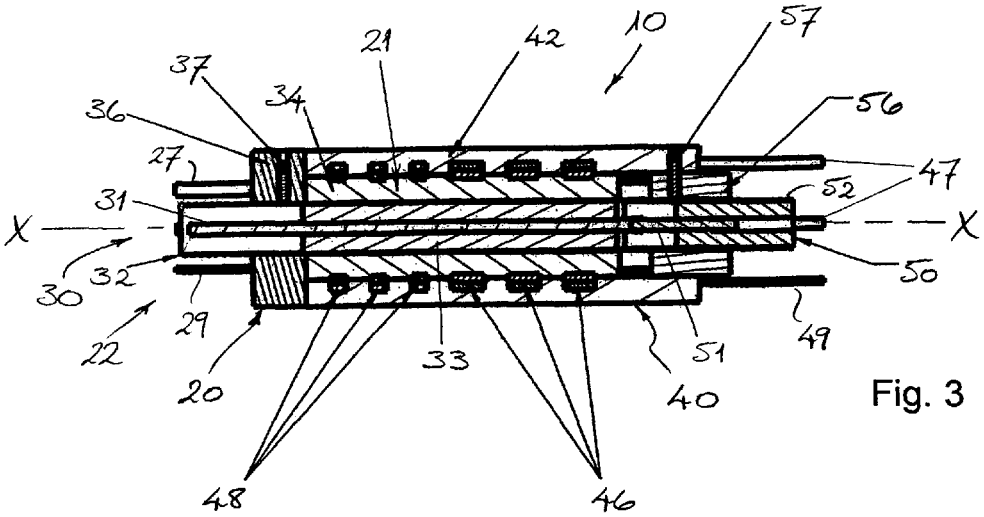
Fig. 3
Fig. 2
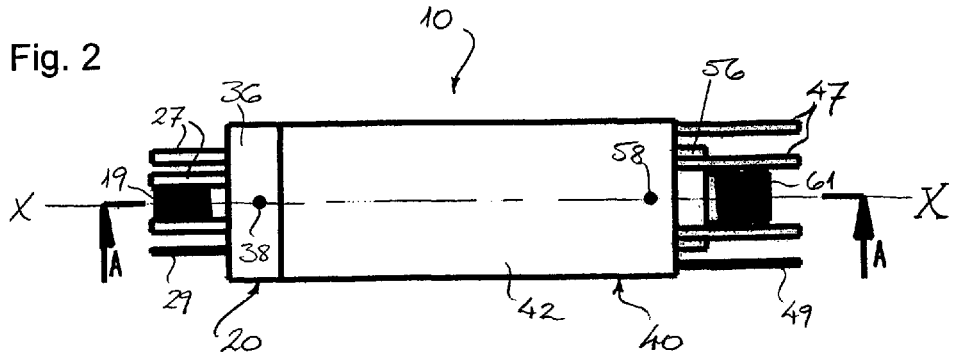

ROTATABLE ELECTRICAL COUPLING AND CONNECTOR THEREFOR

CROSS-REFERENCE TO RELATED APPLICATIONS

This application is a U.S. National Phase Application of International Application No. PCT/EP2010/00598 filed Sep. 30, 2010, which claims the benefit of European Patent Application No. 09012828.1 filed Oct. 9, 2009. These prior applications are incorporated herein by reference in their entirety.

TECHNICAL FIELD

The present invention relates to a rotatable electrical coupling and to an electrical connector for such a coupling.

The rotatable electrical coupling of the invention is desirably designed for use in a swivel or pivot joint of a mounting arm, such as the type of mounting arm used for supporting or suspending technical equipment, e.g. in medical and in commercial or industrial environments. In this way, the rotatable coupling of the invention is able to provide reliable electrical communication through the joint of the mounting arm to the technical equipment, regardless of rotary movement of that joint. As such, it will be convenient to hereinafter describe the invention in this particular context. It will be noted, however, that the rotatable electrical coupling and the electrical connector of the invention are not limited to use in a swivel or pivot joint of a mounting arm.

BACKGROUND OF THE INVENTION

An electrical coupling of the type to which the present invention relates typically comprises two connector components which are configured to be coupled together to interconnect two or more transmission paths to provide electrical communication there-between. Typically, one connector component will be configured as a male or plug-type connector and the other connector component will be configured as a female or socket-type connector for receiving the male or plug-type connector.

An example of a rotatable electrical coupling of the type for use in a swivel or pivot joint of a mounting arm is described in International Patent Application Publication No. WO03/092127 A1. It has been found, however, that such coupling designs are not always suitable to meet the requirements demanded of equipment mounting systems in modern healthcare, commercial and industrial applications. In particular, the technical equipment which is to be supported or suspended on such carrier arm systems often demand connection performance not provided by prior art coupling arrangements.

SUMMARY OF THE INVENTION

Thus, the present invention has been developed to meet this need. In particular, the present invention provides a new and improved rotatable electrical coupling for use in a swivel or pivot joint of an equipment mounting system.

According to one broad aspect, the present invention provides a rotatable electrical coupling comprising: a first connector having at least one electrical contact member for conducting or transmitting a supply current or a low-frequency control signal, and a further electrical contact member adapted to conduct or transmit a high-frequency and/or high-speed data signal; and a second connector to be coupled with the first connector such that the first and second connectors are adapted for relative rotation. The second connector includes complementary electrical contact members configured to maintain uninterrupted electrical contact with each of the respective contact members of the first connector throughout a relative rotational movement between the first and second connectors. The relative rotational movement may be through an angle of at least about 60°, more preferably at least about 90°, further preferably at least about 180°, and most preferably at least about 360°.

In the context of the present invention, the reference to "high-frequency" data signals in this description will be generally understood to refer to frequencies in the UHF range and higher, namely electromagnetic signals having a frequency of about 300 MHz and higher (the UHF band range generally deemed to extend to about 3 GHz), and preferably including SHF signals up to about 30 GHz, and more preferably including EHF signals up to about 300 GHz. Further, the reference to "high-speed" data signals in this description will be generally understood to refer to digital data transmission rates of about 100 kbit/s or more, and preferably includes transmission rates up to about 100 Mbit/s, and more preferably includes transmission rates up to about 100 Gbit/s, and even higher. In this way, the further electrical contact member adapted conduct or transmit a high-frequency and/or high-speed data signal may, for example, be adapted for high quality image transmission via UHF, digital video, and/or digital HDTV signals.

In a preferred form of the invention, the first connector is a male or plug-type connector, and the second connector is a female or socket-type connector for receiving the male connector. Thus, in a preferred form, the invention provides a rotatable electrical coupling comprising: a male connector having at least one electrical contact member for conducting or transmitting a supply current or a low-frequency control signal, and a further electrical contact member adapted to conduct or transmit a high-frequency and/or high-speed data signal; and a female connector for receiving the male connector such that the male connector is adapted for rotation relative to the female connector, or vice versa. The female connector includes complementary electrical contact members configured to maintain uninterrupted electrical contact with each of the respective contact members of the male connector throughout the relative rotational movement between the male and female connectors. The male connector is desirably adapted to be readily inserted and/or withdrawn from the female connector by a user. That is, the connectors of the electrical coupling of the invention are typically adapted for repeated releasable interconnection with one another.

In a preferred form of the invention, the male connector comprises a protruding portion for receipt within a cavity or socket of the female connector, and the at least one electrical contact member for conducting or transmitting a supply current or a low-frequency control signal is arranged on an exterior of the protruding portion. In this regard, the at least one electrical contact member for conducting or transmitting a supply current or a low-frequency control signal may be arranged on an end of the connector for axial or facing engagement with the complementary contact member of the other connector. More usually, however, this at least one electrical contact member will be arranged on a lateral exterior of the protruding portion for radial engagement with the complementary contact member of the other connector.

In a preferred form of the invention, the male connector comprises a plurality of electrical contact members adapted to conduct or transmit a supply current or a low-frequency control signal. This plurality of electrical contact members are preferably arranged spaced apart from one another on the male connector. For example, they may be radially spaced apart from one another. More preferably, however, they are spaced apart along a length of the male connector, i.e. along a length of the protruding portion. Each of these electrical contact members is preferably arranged around and/or extends circumferentially of the protruding portion and is preferably adapted to engage or connect with a complementary contact member in a radial direction to establish an electrical connection there-between. Thus, each contact member may be ring-shaped. Accordingly, the female connector member preferably comprises at least one complementary electrical contact member located inside the cavity or socket for electrical contact with the at least one electrical contact member of the male connector for conducting or transmitting a supply current or a low-frequency control signal. This at least one complementary electrical contact member of the female connector is preferably arranged around or extending circumferentially within the cavity, and is preferably also substantially ring-shaped.

In a preferred form of the invention, the further electrical contact member adapted to conduct or transmit a high-frequency data signal and/or high-speed data signal is arranged substantially centrally of the male connector and/or along the rotational axis thereof. This further electrical contact member is preferably elongate and may be substantially encompassed or surrounded by the electrical contact member(s) that conduct(s) or transmit(s) a supply current or a low-frequency control signal. Where, for example, the male connector comprises a plurality of contact members for conducting a supply current or a low-frequency control signal spaced apart along a length of the male connector, the further electrical contact member for the high-frequency data signal may extend axially through those contact members and/or be substantially encompassed or surrounded by them. Thus, the female or socket-type connector typically also includes a complementary further contact member adapted to conduct or transmit a high-frequency and/or high-speed data signal arranged substantially centrally thereof and/or along the rotational axis.

In a preferred form of the invention, the further electrical contact member adapted to conduct or transmit a high-frequency and/or a high-speed data signal is substantially fully insulated from the one or more electrical contact members for conducting or transmitting a supply current or low-frequency control signal. That is, the further electrical contact member for conducting or transmitting a high-frequency and/or high-speed data signal is preferably substantially encased within or surrounded by a sheath or mantle of dielectric (i.e. electrically insulating) material, such as a polymer plastic material like polyethylene (PE) or polytetrafluoroethylene (PTFE).

In a preferred form of the invention, the further electrical contact member for conducting or transmitting a high-frequency data and/or high-speed data signal is configured to be at least partially rotationally symmetrical about the rotational axis of the coupling—i.e. at least in the region where the further electrical contact member comes into engagement or contact with a complementary contact member. That is, the further electrical contact member is at least partially, and preferably substantially fully, rotationally symmetrical about a central or longitudinal axis of the electrical coupling.

In a highly preferred form of the invention, the further electrical contact member is configured to engage and/or connect with its complementary contact member in the axial direction to establish an electrical connection there-between. The engagement or connection is preferably effected via the axial mating of opposed ends of the respective contact members; for example, in a relatively light frictional fit or via a releasable axially locking attachment.

In a preferred form of the invention, the further electrical contact member is formed as a coaxial contact member, e.g. designed for use with coaxial cable, and includes a screen or shield conductor spaced or arranged radially outwards from a core or central conductor. Thus, the core or central conductor is preferably fully screened or shielded along its length, and the two conductors (i.e. core and shield) are preferably separated by a layer or mantle of dielectric material, such as polyethylene (PE) or polytetrafluoroethylene (PTFE). By carefully selecting the geometry, material and dimensions of the conductors and the layer or mantle of dielectric material, the coaxial contact member can be designed to have a specific characteristic impedance for high signal transmission performance with minimised reflection. For example, the characteristic impedance may be designed to be 30 Ohm, 50 Ohm or 75 Ohm, and is preferably designed to be within the range of 30 to 200 Ohm. Furthermore, by forming the coaxial contact member fully shielded, little or no interference and little or no sensitivity to interference arises in transmission of the high-frequency and/or high-speed data signal via this contact member.

In another preferred form of the invention, the further electrical contact member comprises a waveguide, such as an optical waveguide for conducting or transmitting electromagnetic waves in the optical spectrum (i.e. light). In other words, the high-frequency and/or a high-speed data signals may be transmitted as light via an optical waveguide. In this context, one of the most common examples for such a waveguide is one or more optical fibre, particularly optical glass fibres.

The further (e.g. coaxial) contact member may be configured as a plug-type contact member or a socket-type contact member, for engagement with the complementary one of those two. Importantly, it will be noted that the choice of whether the further contact member is configured as a plug-type or a socket-type contact member is independent of whether the connector of the electrical coupling is a male connector or a female connector. That is, the further contact member in the male connector may be of either the plug-type or the socket-type for respective connection with the complementary further contact member in the female connector.

Thus, the present invention provides an electrical coupling which is configured for conduction or transmission not only of supply currents and/or low-frequency control signals as is known in conventional rotatable electrical couplings via wiper or sliding contact arrangements, but which is also specifically designed to incorporate transfer of high-frequency data signals and/or high-speed data signals, such as UHF, digital video, and digital HDTV signals, while still permitting rotation of the coupling through at least about 180°, more preferably through at least about 360°, and most preferably with unlimited or full rotational flexibility permitting repeated rotation. Thus, the electrical coupling of the invention is able to provide multiple transmission paths for simultaneous communication of power supply, control signals and high-frequency and/or high-speed data signals to or from one or more items of technical equipment mounted on an end of an articulated support arm, with the coupling and cabling incorporated within the support arm.

According to another broad aspect, the present invention provides an electrical connector for electrical connection with a complementary component e.g. socket or plug, the connector comprising: at least one electrical contact member adapted to conduct or transmit a supply current or a low-frequency control signal, and a further electrical contact member adapted to conduct or transmit a high-frequency data signal and/or a high-speed data signal. The connector is configured to provide an uninterrupted electrical connection to each of the electrical contact members throughout a rotational movement of the connector relative to the complementary socket or plug, wherein the relative rotational movement is preferably through an angle of at least about 60°, more preferably at least about 90°, further preferably at least about 180°, and most preferably at least about 360°, to provide an unlimited or full rotational flexibility permitting repeated or continual rotation.

In a preferred form of the invention, the further electrical contact member is arranged substantially centrally of the connector and/or on the rotational axis, and is preferably substantially encompassed or surrounded by the at least one contact member adapted to conduct or transmit a supply current or low-frequency signal. The further electrical contact member is preferably formed as a coaxial member.

In a preferred form of the invention, the connector comprises a plurality of electrical contact members adapted to conduct or transmit a supply current or low-frequency control signal. The plurality of electrical contact members are preferably arranged spaced apart from one another on the connector. They may be radially spaced apart from one another, for example. More preferably, however, they may be spaced apart along a length of the male connector. In this case, the plurality of electrical contact members may comprise: at least one first electrical contact member adapted to conduct or transmit a supply current, and at least one second electrical contact member adapted to conduct or transmit a low-frequency control signal.

As noted above, in a preferred form of the invention the further electrical contact member for conducting or transmitting a high-frequency and/or high-speed data signal is substantially fully shielded from the at least one first or second electrical contact members. For example, the further electrical contact member may be substantially fully sheathed and electrically insulated from the at least one first or second electrical contact members. That is, the further electrical contact member is preferably substantially surrounded by a sheath or mantle of dielectric material, such as a polymer plastic material.

In one particular form of the invention, the electrical connector is a male or plug-type connector for electrical connection with a complementary socket. The male connector thus comprises a protruding portion for receipt within the socket, and the at least one electrical contact member for conducting or transmitting a supply current or a low-frequency control signal is arranged on an exterior of the connector, preferably arranged around or extending circumferentially of the connector, and in a particular embodiment being substantially ring-shaped.

In another particular form of the invention, the electrical connector is a female or socket-type connector for electrical connection with a complementary plug, such that the connector has a cavity for receipt of the complementary plug. The at least one electrical contact member for conducting or transmitting a supply current or a low-frequency control signal is then preferably arranged within the cavity, preferably arranged around or extending circumferentially of the cavity, and in a particular embodiment is again substantially ring-shaped.

In a preferred form of the invention, the further electrical contact member for conducting or transmitting a high-frequency data and/or high-speed data signal is configured to be at least partially rotationally symmetrical about the rotational axis of the coupling—i.e. at least in the region where the further electrical contact member comes into engagement or contact with a complementary contact member. That is, the further electrical contact member is at least partially, and preferably substantially fully, rotationally symmetrical about a central or longitudinal axis of the electrical coupling.

In a highly preferred form of the invention, the further electrical contact member is configured to engage and/or connect with its complementary contact member in the axial direction. The engagement or connection is preferably effected via axial mating of opposed ends of the respective contact members; for example, in a relatively light frictional fit or a releasable axially locking attachment. Thus, the opposed ends of the respective contact members approach one another and engage in the axial direction.

In a preferred form of the invention, the electrical contact members are formed from a material selected from the group consisting of: copper, silver, gold, alloys of any one of copper, silver, and gold, and any combination of same, including plating. The materials may thus also include alloys such as bronze and brass.

BRIEF DESCRIPTION OF THE DRAWINGS

The above and further features and advantages of the invention will become more readily apparent from the following detailed description of preferred embodiments of the invention with reference to the accompanying drawings, in which like reference characters identify like features, and in which:

FIG. 1 is a perspective view of a rotatable electrical coupling according to a preferred embodiment of the invention in an assembled state;

FIG. 2 is a plan view of the rotatable electrical coupling of FIG. 1;

FIG. 3 is a vertical cross-section of the rotatable electrical coupling of FIG. 1 along the central axis X of the coupling and viewed in the direction of arrows A-A in FIG. 2;

DETAILED DESCRIPTION OF THE PREFERRED EMBODIMENTS

Figures 4, 5:
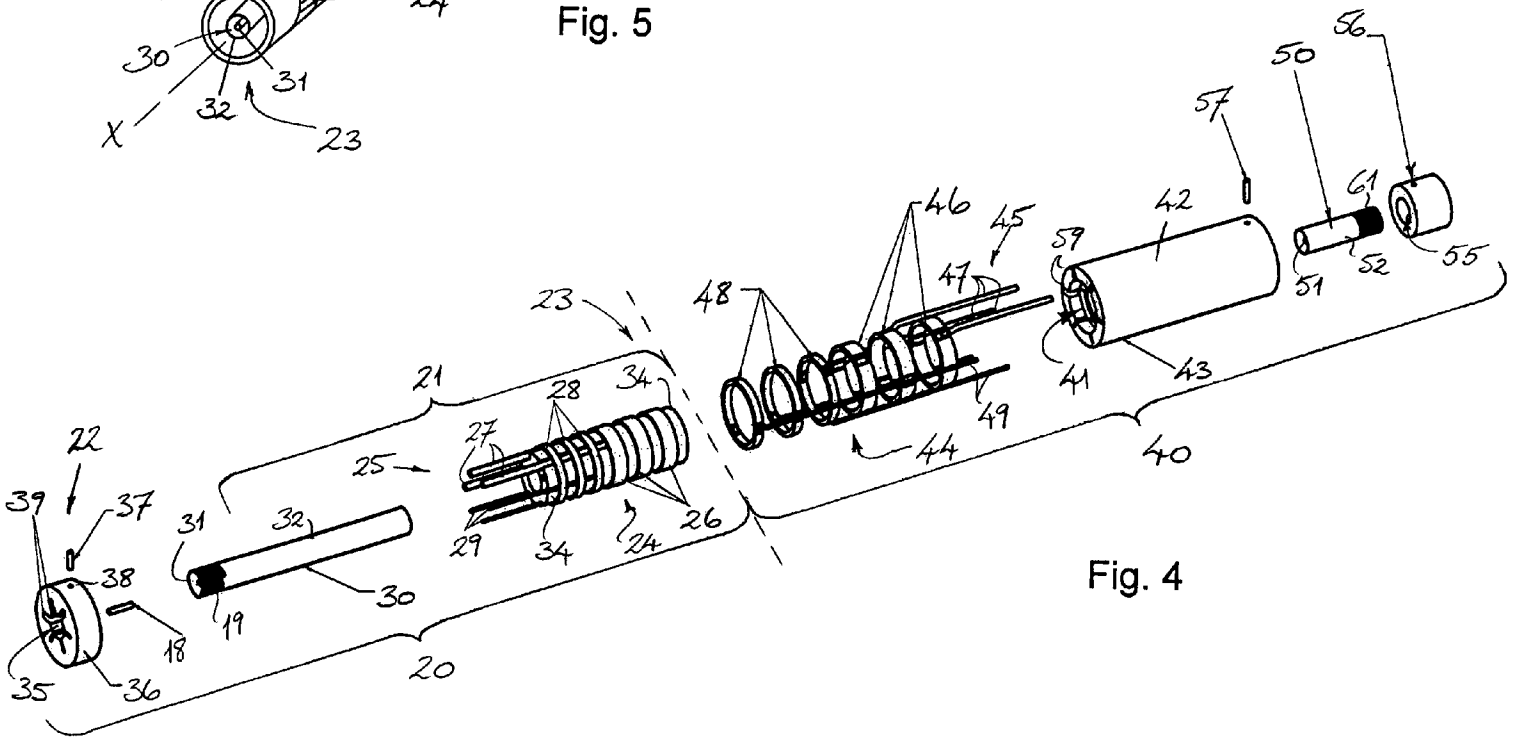
FIG. 4 is an exploded perspective view of the components of the rotatable electrical coupling of FIG. 1.
FIG. 5 is a perspective view of a male or plug-type electrical connector according to a preferred embodiment of the invention for a rotatable electrical coupling.

With reference to FIGS. 1 to 4 of the drawings, a rotatable electrical coupling 10 according to a preferred embodiment of the invention will now be described. The electrical coupling 10 comprises a male or plug-type connector 20 and a female or socket-type connector 40, which are shown combined in FIGS. 1 to 3 of the drawings in rotatable coupled engagement. As FIG. 1 and FIG. 2 of the drawings only show external views of the coupling 10 with the male connector or plug 20 and the female or socket-type connector 40 in a combined or coupled state, the precise nature or structure of the male and female connectors 20, 40 is not fully clear from those two drawings. Details of the male connector 20 and the female connector 40 can be more clearly seen in FIG. 3 and FIG. 4 of the drawings.

With particular reference now to FIGS. 3 and 4 of the drawings, therefore, the male or plug-type connector 20 can be seen to comprise an elongate protruding portion 21 which extends from a proximal end 22 of the male connector 20 and terminates at a free distal end 23. The protruding portion 21 of the male connector 20 is designed to be received within a corresponding cavity 41 formed within a generally cylindrical casing 42 of the female or socket-type connector 40. The cavity or socket 41 in the female connector 40 extends approximately centrally of the cylindrical casing 42 from a proximal end of the connector 40 to an opening at a distal end 43, into which opening the free end 23 of the protruding portion 21 is designed to be inserted. In this connection, the cavity 41 of the female connector 40 desirably has a geometry which essentially complements the size and shape of the protruding portion 21 of the male connector or plug 20. In particular, as the male and female connectors 20, 40 of the electrical coupling 10 are designed for relative rotation, the respective geometries of the protruding portion 21 and the cavity 41 are selected or configured to accommodate such relative rotation.

In this embodiment, the male connector 20 has a plurality of ring-shaped electrical contact members 24 which extend completely around an outer periphery of the protruding portion 21 and are arranged spaced apart and generally axially aligned along a longitudinal extent of the protruding portion 21. These ring-shaped contact members 24 are preferably fabricated from copper, silver, gold, or alloys thereof and are designed as wiper or sliding ring contacts for electrical communication via their radial outer surfaces when those outer surfaces come into physical engagement (e.g. wiping or sliding contact) with complementary electrical contact members of the female connector 40. Furthermore, each of the ring-shaped contact members 24 has a lead 25 which extends longitudinally to the proximal end 22 of the male connector 20 for connecting the respective contact members 24 either to an electrical supply or signal source (not shown) on the one hand, or to an electrical load or a signal receiver (not shown) on the other hand. The leads 25 of the male connector 20 preferably extend radially inwardly of the contact members 24.

In this particular embodiment, the ring-shaped contact members 24 are divided into two groups, and include three first wiper rings 26 of somewhat broader width arranged adjacent one another at the distal end 23 of the protruding portion 21 for conducting or transmitting a supply current, with each of the first wiper rings 26 having a respective connecting lead 27. Furthermore, the ring-shaped contact members 24 also include three second wiper rings 28 of narrower width arranged adjacent one another for conducting or transmitting a low-frequency control signal, with each of the second wiper rings 28 having a respective connecting lead 29. In this way, the male connector 20 is configured to conduct or transmit three separate power supply currents and three separate control signals in parallel, and these may optionally be communicated to three items of equipment.

As can be clearly seen in the drawings, arranged centrally of the male connector 20 is a further, third electrical contact member 30 provided in form of a coaxial contact adapted to conduct or transmit a high-frequency and/or high-speed data signal, such as a HDTV signal. The coaxial contact member 30 is an elongate component which is arranged substantially aligned on a central longitudinal axis X of the protruding portion 21 such that it extends through each of the ring-like contact members 24 (i.e. ring contacts 26, 28). In this regard, the third contact member 30 comprises a central or core conductor 31 and an outer screen or shield 32 typically having a generally cylindrical shape and formed as a conductor sleeve or tube which surrounds the core 31 to provide a full and continuous shield along the length thereof. The central or core conductor 31 and the outer screen/shield 32 are separated by a generally cylindrical (i.e. annular) layer or mantle 33 of dielectric material. Furthermore, it will seen that an annular jacket or mantle 34 of insulating dielectric material is provided between the coaxial contact member 30 and the first and second ring-shaped contact members 26, 28 extending around the periphery or circumference of the protruding portion 21. The first and second ring contacts 26, 28 are thereby insulated from one other and from the third coaxial contact by the annular jacket or mantle 34 of dielectric material. The leads 27, 29 of the first and second ring contacts 26, 28 extend embedded within slots within the jacket or mantle 34 spaced radially inwards of the ring contacts 26, 28.

With further reference to drawing FIGS. 3 and 4, it will be appreciated that the assembly of the male connector 20 involves securing an end of the elongate coaxial contact member 30 within a recess 35 formed centrally in a mounting collar 36 provided at the proximal end 22 of the male connector 20. For this purpose, a small threaded screw or pin 37 is screwed into a threaded hole 38 such that an end of the screw or pin 37 engages and securely fastens the end of the coaxial contact member 30 within the recess 35 in the mounting collar 36. It will be appreciated that more than one such pin or screw 37 may be provided, e.g. radially offset from one another in the collar 36. The proximal end of the elongate coaxial contact member 30 may be inserted through the annular jacket or mantle 34 of dielectric material (which is typically somewhat resilient) in an interference fit to combine it with the ring-shaped contact members 24 of the protruding portion 21. This thereby unifies all of the first, second, and third contact members 26, 28, 30 within the construct of the male connector 20.

Radial slots 39 extend from the central recess 35 of the mounting collar 36 for receiving ends of the connecting leads 25 extending from the ring-shaped contact members 24. In this particular embodiment, the respective connecting leads 27, 29 from the first and second ring contacts 26, 28 are offset at substantially equal angular spacings (i.e. about 60°) around the central axis X of the protruding portion. Thus, the slot-like recesses 39 extend radially outwards from the central recess 35 spaced apart at about 60°. It will be appreciated that these radial slots 39 may also be formed as circular holes for receiving the ends of each of the leads 27, 29. This construction helps ensure that torque applied to the mounting collar 36 is transferred to the first and second ring contacts 26, 28. Similarly, the threaded screw or pin 37 helps ensure that torque applied to the mounting collar 36 is transferred to the third contact member 30. A further pin 18 may be provided to interconnect the collar 36 with the insulating jacket 34 for reliable torque transfer there-between, the pin 18 being received within an eccentric hole (not shown) in the mounting collar 36 and a corresponding hole in the jacket 34.

As is apparent from the drawings, the end of the coaxial contact member 30 at the proximal end 22 of the male connector 20 may include a screw thread 19 for connection e.g. with a coaxial cable for conducting or transmitting a high frequency and/or high-speed data signal. Similarly, the ends of the leads 27, 29 which project at the proximal end 22 of the male connector 20 are available for connection to a power supply/power load and to a signal source/signal receiver, respectively.

Focussing now on the female connector 40 in this embodiment of the invention, it will be appreciated that the female connector has a complementary structure to the male connector 20. Thus, in a corresponding manner, the female connector 40 in this embodiment comprises a plurality of ring-shaped electrical contact members 44 which extend completely around an inner periphery of the socket or cavity 41 and are arranged spaced apart and generally axially aligned along a longitudinal extent of that cavity. Again, these ring-shaped contact members 44 are designed as wiper ring-contacts for electrical communication via their exposed, radially inner surfaces when those surfaces come into physical engagement (e.g. wiping or sliding contact) with the complementary contact members 24 of the male connector 20. Further, each of these ring-shaped contact members 44 has a lead 45 which extends longitudinally to the proximal end of the female connector 40 for connecting the respective contact member 44 either to an electrical supply or signal source (not shown) on the one hand, or to an electrical load or a signal receiver (not shown) on the other hand. The leads 45 of the female connector 40 extend within the casing 42 at positions radially outwards of the contact members 44.

As with the male connector 20, the ring-shaped contact members 44 of the female connector 40 are divided into two groups, and include three first wiper rings 46 of somewhat broader width arranged adjacent one another and adapted to conduct or transmit a supply current, with each of the first wiper rings 46 having a respective connecting lead 47. In addition, the ring-shaped contact members 44 include three second wiper rings 48 of narrower width arranged adjacent one another and adapted to conduct or transmit a low-frequency control signal, with each of the second wiper rings 48 having a respective connecting lead 49. Thus, the first and second ring contacts 46, 48 of the female connector or socket 40 are positioned at an inner periphery of the cavity 41 in the cylindrical casing 42 for registration or alignment with the corresponding first and second ring-shaped contact members 26, 28 of the male connector 20 when the protruding portion 21 of the male connector is inserted into the cavity. The casing 42 is typically formed of a relatively robust dielectric material, such as polyvinyl chloride (PVC) or another suitable non-conducting material.

Also corresponding with the male connector, the female connector 40 can be clearly seen in the drawings to include a further, third electrical contact member 50 in the form of a coaxial contact arranged centrally thereof and adapted to conduct or transmit a high-frequency and/or high-speed data signal, such as a HDTV signal. This coaxial contact member 50 is again an elongate component which is arranged in alignment on the central longitudinal axis X of the casing 42. The coaxial contact member 50 in the female connector 40 is much shorter than the complementary coaxial contact 30 in the male connector 20 because it does not extend through any of the ring-like contact members 44 (i.e. 46, 48). On the contrary, its most distal end is still within the proximal end of the cavity 41 in the casing 42 in order to leave sufficient space for insertion of the male connector 20. As before, the coaxial contact member 50 comprises a central or core conductor 51 and an outer screen or shield conductor 52 typically having a generally cylindrical shape and formed as a sleeve or tube which surrounds the core 51 and forms a full shield along the length thereof. The central or core conductor 51 and the outer screen/shield 52 are separated by a generally cylindrical or annular mantle 53 of a dielectric material. It will be noted, however, that the coaxial contact member 50 is not surrounded by any jacket or mantle of insulating material. In this regard, the jacket or mantle 34 of dielectric material in the protruding portion 21 already provides an insulating barrier between the ring-shaped contact members 24, 44 and the coaxial contact members 30, 50 when the male component 20 is received within the female component 40. Nevertheless, a small jacket or mantle of insulating material around the proximal end of the coaxial contact member 50 could optionally be provided.

The female connector 40 is also assembled in a manner similar to that for the male connector 20. In particular, the assembly of the female connector 40 again involves securing the coaxial contact member 50 within a recess 55 formed centrally in a mounting collar 56 provided at the proximal end of the connector 40. To this end, a small threaded pin or screw 57 is screwed into a threaded hole 58 formed through the casing 42 and collar 56. In this case, the pin or screw 57 firstly secures the collar 56 to the casing 42 and an end of the screw also engages and securely fastens the coaxial contact member 50 within the recess 55 in the mounting collar 56. As before, it will be noted that more than one such pin or screw 57 may be provided, e.g. radially offset from one another in the collar 56. As the ring-shaped first and second contact members 46, 48 of the female connector 40 are arranged at an inner periphery of the cavity 41 of the connector, the leads 47, 49 are arranged and received within longitudinally extending slots or grooves 59 formed in the casing 42. As a result, the mounting collar 56 which receives and holds the coaxial contact member 50 of the female connector 40 need not receive the leads 45 of the ring-shaped contact members 44, as is the case with the male connector 20. Rather, in this example, the leads 45 of the ring-shaped contact members 44 extend radially outwardly of the mounting collar 56 and are arranged angularly spaced from one another, again at about 60° angular spacings. Again the proximal end of the coaxial contact member 50 may include a screw-thread 61 for attaching a cable.

When the male connector 20 is coupled with the female connector 40 by inserting the protruding portion 21 into the cavity 41 of the cylindrical casing 42 fully (as shown in FIG. 3 of the drawings), the rotatable electrical coupling 10 of the present invention is brought into an electrically coupled state. In this state, the respective first contact rings 26, 46 and the respective second contact rings 28, 48 of the male and female connectors 20, 40 come into alignment and wiping or sliding contact with one another (i.e. at their respective opposing surfaces). Furthermore, the respective third electrical contact members 30, 50 also come into axial alignment and axial mating engagement with one another on a common central axis X of the male and female connectors 20, 40. That is, the facing or opposite free ends of the respective third electrical contact members 30, 50 are adapted to engage with one another (e.g. matingly) in the axial direction such that a continuous, and preferably fully shielded coaxial connection is obtained there-between. The coaxial contact members 30, 50 are preferably configured as a coaxial plug-type member and a coaxial socket-type member, respectively. Thus, it will be appreciated that the coaxial contact member 30 of the male connector 20 may be configured as a socket-type member and the coaxial contact member 50 of the female connector 40 may be configured as a plug-type member, or vice versa.

In this connection, the distal end of the shield or screen 32 of the third contact member 30 in the male connector 20 may have an inner diameter which is slightly larger than an outer diameter of the distal end of the shield of screen 52 of the coaxial contact member 50 in the female connector 40. The distal end of the shield or screen 32 may thus receive the distal end of the shield of screen 52 with a slight overlap in a very light friction fit, which ensures continuity of the shielding through the join. Similarly, the distal end of the core conductor 31 may terminate in a cup-shaped receptacle which is adapted to receive and engage the distal end of the core conductor 51. In this way, the facing or opposite ends of the third electrical contact members 30, 50 may be adapted to engage with one another in the axial direction.

Significantly, the engagement or connection between the ends of the coaxial contact members 30, 50 is adapted to permit relative rotation of those members. In particular, these contact members 30, 50 are in alignment on a common central or longitudinal axis X which is also the axis of relative rotation for the male and female connectors 20, 40. The facing and engaging ends of the coaxial contact members 30, 50 are designed to be rotationally symmetrical to thus provide uninterrupted (and fully shielded) signal transmission irrespective of relative rotation between the connectors 20, 40 about the central or longitudinal axis X. The engaging ring-shaped contact members 24, 44 similarly provide uninterrupted current and/or signal transmission irrespective of relative rotation between the connectors 20, 40 about the longitudinal axis X.

The protruding portion 21 of the male connector 20 is desirably dimensioned such that it is able to be relatively easily inserted into and withdrawn from the cavity 41 of the female connector 40. Furthermore, the male and female connectors 20, 40 of the invention are quite precisely dimensioned such that all of the electrical contact members, i.e. the first ring-shaped contact members 26, 46 for conducting supply current, the second ring-shaped contact members 28, 48 for transmitting low frequency control signals, and the third coaxial contact members 30, 50 for transmitting high-frequency and/or high-speed data signals come into full contact or engagement with one another substantially simultaneously—i.e. upon the protruding portion 21 of the male connector 20 being fully inserted into the cavity or socket 41 of the female connector 40. In this way, the coupling provides for the simultaneous transmission of three supply currents, three control signals, and a high-frequency and/or high-speed data signal for multiple items of equipment. At the same time, the electrical coupling 10 of the invention is configured such that the male connector 20 may rotate about the central axis X relative to the female connector 40 e.g. through a full 360° while providing uninterrupted electrical contact between the respective electrical contact members of the coupling.

In a preferred configuration, the respective electrical contact members of the male and female connectors 20, 40 may have a degree of springiness or resilience to enhance their contact with one another. For example, the ring-shaped electrical contact members 24 of the male connector 20 may be resiliently biased in a radially outward direction, the ring-shaped electrical contact members 44 of the female connector 40 may be resiliently biased in a radially inward direction, and/or the coaxial contact members 30, 50 may be resiliently biased in an axial direction (i.e. along the X-axis towards the distal end of the respective connector). On the one hand, this resilient bias may help to ensure that the desired uninterrupted electrical contact is maintained despite small manufacturing tolerances and/or a small degree of wear during the service life of the coupling. On the other hand, such resilient bias may also help to prevent damage to the contact members in the event that the male and female connectors 20, 40 of the coupling 10 are too forcefully combined. The male and female connectors 20, 40 may also be configured to prevent an axial over-loading of the third contact members 30, 50 by providing a stop or abutment (e.g. the collar 36) against further or excessive insertion of the male connector 20 into the cavity 41 of the female connector 40.

Furthermore, the electrical coupling 10 of the invention may optionally include a latch mechanism (not shown) for preventing the male and female (i.e. plug and socket) connectors 20, 40 from inadvertently separating or disconnecting from each other during use. Thus, the latch mechanism may need to be released, for example by applying a threshold axial force (e.g. against a spring biased pawl mechanism) or by activating a switch, button or lever device, in order then to separate or disconnect the coupled male and female connectors 20, 40.

With reference now to FIG. 5 of the drawings, a schematic perspective view of a protruding portion 21 of a male or plug-type connector 20 according to the present invention is illustrated. In this particular embodiment, four ring-shaped contact members 24 are shown provided around an outer radial periphery of the protruding portion 21 and a centrally located coaxial contact member 30 is also illustrated. The coaxial contact member 30 extends along a central longitudinal axis X of the protruding portion 21 and, as before, is radially separated from the surrounding ring-shaped contact members 24 by a jacket or mantle 34 of dielectric material. This jacket or mantle 34 electrically isolates the ring-shaped contact members 24 both from each other and from the coaxial contact member 30. The ring contacts 24 are again designed for wiping or sliding contact over their radially outer surfaces with complementary contact members in a female or socket-type connector designed to receive the protruding portion 21 of the plug 20.

It will be appreciated that the above description of the preferred embodiments of the invention with reference to the drawings has been made by way of example only. Thus, a person skilled in the art will appreciate that various changes, modifications and/or additions may be made to the parts particularly described and illustrated without departing from the scope of the invention as defined in the claims. In this regard, while the preferred embodiments of the invention have been described as comprising male and female connectors or plug- and socket-type connectors, it will be understood that connectors may be designed which embody the features of this invention despite the fact that, by their appearance, they may seem to be neither strictly "male" nor "female". As the skilled person will appreciate, however, such connectors may nevertheless fall within the scope of the invention as defined in the appended claims.

The invention claimed is:

1. A rotatable electrical coupling comprising:

a first connector having at least one electrical contact member for conducting or transmitting a supply current or a low-frequency control signal, and a further electrical contact member for conducting or transmitting a high-frequency and/or a high-speed data signal; and a second connector to be coupled with the first connector such that the first and second connectors are adapted for rotation relative to one another, wherein the second connector includes complementary electrical contact members engageable with the contact members of the first connector such that they maintain uninterrupted electrical contact members with each of the respective contact members of the first connector throughout a relative rotational movement between the first and second connectors, preferably through an angle of at least about 180°,wherein the first connector is a male connector and the second connector is a female connector adapted to releasably receive the male connector, wherein the female connector member comprises at least one complementary electrical contact member arranged inside the cavity or socket and arranged around or extending circumferentially of the cavity or socket.

2. The rotatable electrical coupling according to claim 1, wherein the further electrical contact member adapted to conduct or transmit a high-frequency and/or high-speed data signal is arranged substantially centrally of the first connector and/or along the rotational axis thereof, and/or wherein the further electrical contact member is substantially encompassed or surrounded by the at least one electrical contact member adapted to conduct or transmit a supply current or a low-frequency control signal.

3. The rotatable electrical coupling according to claim 1, wherein the second connector comprises a complementary contact member adapted to conduct or transmit a high-frequency data signal arranged substantially centrally thereof and/or along the rotational axis.

4. The rotatable electrical coupling according to claim 1, wherein the further electrical contact member for conducting or transmitting a high-frequency and/or a high-speed data signal is adapted to engage a complementary contact member in an axial direction for uninterrupted communication or transmission in relative rotation.

5. A rotatable electrical coupling according to claim 1, wherein the first connector comprises a plurality of electrical contact members adapted to conduct or transmit a supply current or a low-frequency control signal, said plurality of electrical contact members being arranged spaced apart from one another on the first connector, preferably being spaced apart along a length of the first connector.

6. The rotatable electrical coupling according to claim 1, wherein the male connector comprises a protruding portion for receipt within a cavity or socket of the female connector, with the at least one electrical contact member for conducting or transmitting a supply current or a low-frequency control signal being arranged on an exterior of the protruding portion, preferably arranged around or extending circumferentially of the protruding portion, and preferably being substantially ring-shaped.

7. The rotatable electrical coupling according to claim 1, wherein the at least one complementary electrical contact member is substantially ring-shaped.

8. The rotatable electrical coupling according to claim 1, wherein the further electrical contact member adapted to conduct or transmit a high-frequency and/or high-speed data signal is fully insulated and/or shielded from the one or more electrical contact members for conducting or transmitting a supply current or a low-frequency control signal, wherein the further electrical contact member is preferably encased within or surrounded by a sheath or mantle of electrically insulating material, such as a polymer plastic insulating material.

9. A swivel or pivot joint of a mounting arm for supporting or suspending technical equipment, wherein the joint incorporates an electrical coupling according to claim 1.

10. An electrical connector being a female or socket-type connector for electrical connection with a complementary plug, the connector having a cavity for receipts of the complementary plug, the connector comprising:

at least one electrical contact member adapted to conduct or transmit a supply current or a control signal, and a further electrical contact member adapted to conduct or transmit a high-frequency and/or a high-speed data signal, wherein the connector is configured to provide uninterrupted electrical connection to each of the electrical contact members throughout a rotational movement of the connector about a rotational axis relative to the complementary socket or plug, wherein the relative rotational movement is preferably through at least about 60°, and more preferably at least about 180°, wherein the as at least one electrical contact member for conducting or transmitting a supply current or a control signal is arranged within the cavity around or extending circumferentially of the cavity.

11. The electrical connector according to claim 10, wherein the further electrical contact member is adapted to engage a complementary contact member in an axial direction to provide for uninterrupted electrical communication or transmission in relative rotation.

12. The electrical connector according to claim 10, wherein the further electrical contact member is arranged substantially centrally of the connector and/or on the rotational axis, and is substantially encompassed or surrounded by the at least one contact member adapted to conduct or transmit a supply current or a control signal.

13. The electrical connector according to claim 10, wherein the further electrical contact member is configured to be rotationally symmetrical about a central or longitudinal axis of the connector.

14. The electrical connector according to claim 10, comprising:

a plurality of electrical contact members adapted to conduct or transmit a supply current or a control signal, said plurality of electrical contact members being arranged spaced apart from one another along a length or around a periphery of the connector; and/or at least one first electrical contact member adapted to conduct or transmit a supply current, and at least one second electrical contact member adapted to conduct or transmit a control signal.

15. The electrical connector according to claim 10, wherein the at least one electrical contact member for conducting or transmitting a supply current or a control signal is ring-shaped.

* * * * *